US005344285A

United States Patent [19]

O'Sullivan et al.

[11] Patent Number: 5,344,285

[45] Date of Patent: Sep. 6, 1994

[54] CENTRIFUGAL PUMP WITH MONOLITHIC DIFFUSER AND RETURN VANE CHANNEL RING MEMBER

[75] Inventors: Mark E. O'Sullivan, Phillipsburg, N.J.; Timothy L. Wotring, Emmaus, Pa.

[73] Assignee: Ingersoll-Dresser Pump Company, Liberty Corner, N.J.

[21] Appl. No.: 131,345

[22] Filed: Oct. 4, 1993

[51] Int. Cl.[5] ..... F04D 1/08; F04D 29/44

[52] U.S. Cl. ..... 415/199.2; 415/199.3; 415/214.1

[58] Field of Search ..... 415/199.1, 199.2, 199.3, 415/208.2, 208.3, 214.1, 915

[56] References Cited

U.S. PATENT DOCUMENTS

| | | | |
|---|---|---|---|
| 2,366,964 | 1/1945 | Howard . | |
| 3,265,001 | 8/1966 | Deters | 415/199.3 |
| 3,477,384 | 11/1969 | Hlinka . | |
| 3,730,641 | 5/1973 | Gordon . | |
| 3,986,791 | 10/1976 | Paciga et al. | 415/208.2 |
| 4,116,583 | 9/1978 | Budris | 415/199.1 |

FOREIGN PATENT DOCUMENTS

| | | | |
|---|---|---|---|
| 92394 | 7/1981 | Japan | 415/199.1 |
| 144689 | 8/1983 | Japan | 415/199.2 |
| 147450 | 10/1962 | U.S.S.R. | 415/199.1 |
| 622669 | 3/1947 | United Kingdom | 415/199.2 |

OTHER PUBLICATIONS

U.S. patent application Ser. No. 08/069,813 for Centrifugal Pump with Improved Diffuser, by J. McKenna, filed Jun. 1, 1993.

*Primary Examiner*—Edward K. Look
*Assistant Examiner*—James A. Larson
*Attorney, Agent, or Firm*—Michael H. Minns

[57] ABSTRACT

A segmental ring centrifugal pump wherein the channel ring and the diffuser/crossover hydraulics are formed as a single monolithic casting. By casting the diffuser and the channel ring as a unit, the monolithic diffuser channel ring member and the diffuser vanes provide structural support to the channel ring. The channel ring wall thickness has been reduced by taking advantage of the reinforcing function of the monolithic cast piece. The reinforcement of the channel ring wall and the minimum wall thickness can be adjusted by modifying the radius between the diffuser vanes and the channel ring.

5 Claims, 5 Drawing Sheets

CENTRIFUGAL PUMP WITH MONOLITHIC DIFFUSER AND RETURN VANE CHANNEL RING MEMBER

BACKGROUND OF THE INVENTION

This invention relates generally to centrifugal pumps and more particularly to segmental ring or channel ring centrifugal pumps.

In one type of multi-stage centrifugal pump, known as a segmental ring or channel ring pump, the pressure boundary of pump consists of channel rings located between suction and discharge heads, centered by rabbet fits and secured with tie bolts.

In traditional designs, the channel ring features a disc-shaped casting which houses a diffuser/crossover. A channel ring assembly may also be formed by locating an aligning ring around the crossover/diffuser hydraulics with a radial interference fit. Both these designs require substantial channel ring wall thickness to keep actual circumferential stress components below allowable stress levels.

A heavy channel ring wall adds a significant amount of weight and cost to the pump, and also affects the heads and tie bolts. Larger diameter heads and heavier tie bolts are required for thicker channel ring sections. This additional cost is realized both in the channel ring weight and in the increase in the overall pump dimensions.

In addition to the economic advantages of reducing the vessel wall thickness, reducing the channel ring thickness makes the pump less sensitive to thermal transients. In boiler feed service, especially in co-generation systems, segmental ring pumps may be exposed to sever temperature transients. During a transient, the tie bolt temperature lags behind the channel ring temperature. High stress levels may be generated due to differential expansion between the tie bolts and the channel rings. The conduction of heat from the pump internals or fluid passages to the tie bolts is inversely proportional to the wall thickness. Minimizing the channel ring thickness will reduce differential expansion between the bolting and the channel rings and minimize thermal stress levels.

The foregoing illustrates limitations known to exist in present channel ring centrifugal pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a multistage centrifugal pump comprising: a discharge member; a suction member; a plurality of pumping stages between the suction member and the discharge member, each pumping stage comprising an impeller and a monolithic diffuser and return vane channel ring member; and a plurality of tie bolts extending from the discharge member to the suction member, the tie bolts fastening the monolithic diffuser and return vane channel ring members between the suction member and the discharge member whereby the suction member, the discharge member and the plurality of diffuser and return vane channel ring members form a pressure boundary.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
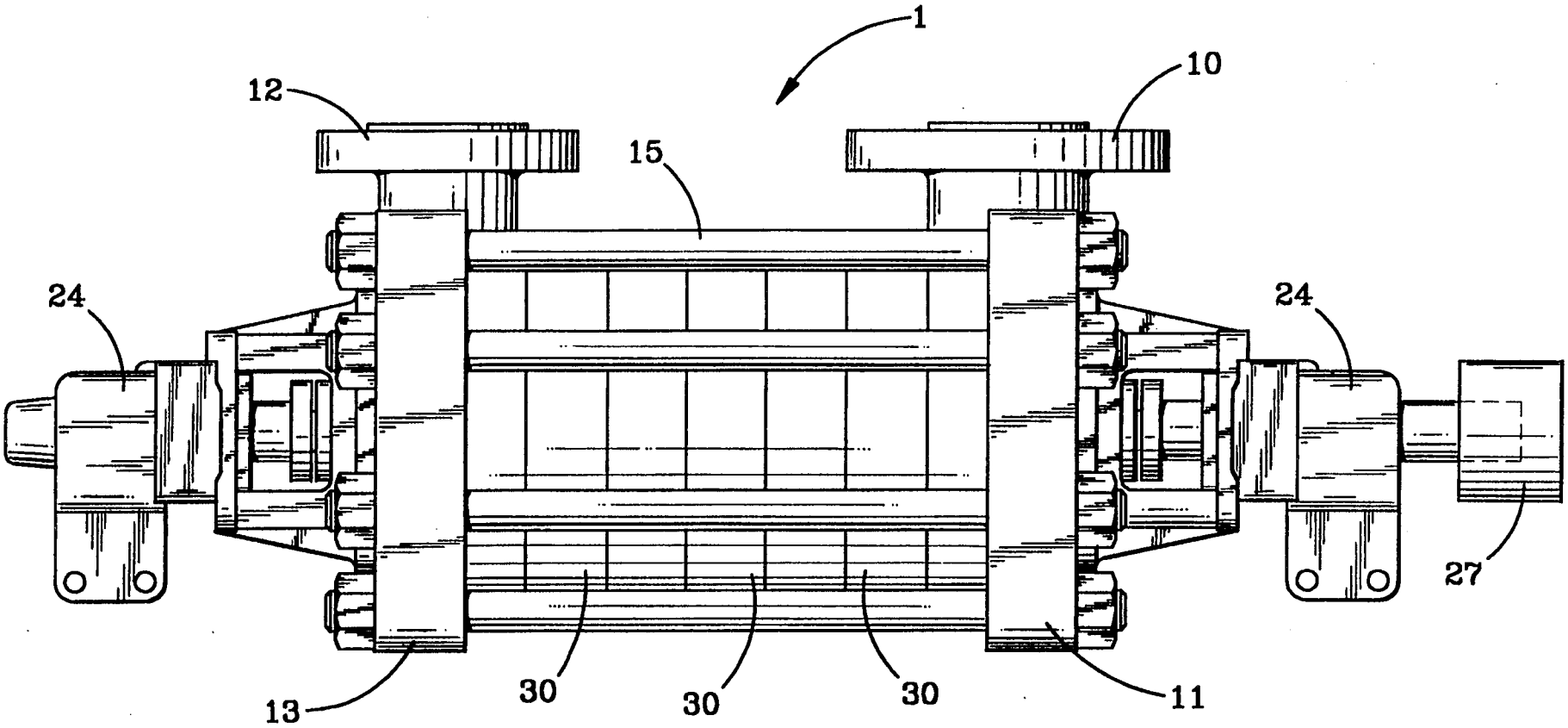
FIG. 1 is a side view of a segmental ring multi-stage centrifugal pump.

FIG. 1 shows a multi-stage segmental ring centrifugal pump 1 having an inlet 10 and an outlet 12. The segmental ring pump 1 consists of a suction head 11, a discharge head 13, a plurality of multiple pumping stages consisting of an impeller 25 attached to a rotating shaft 20 and a monolithic diffuser and return vane channel ring member 30. The suction head 11, discharge head 13 and monolithic diffuser and return vane channel ring members 30 are secured with tie bolts 15. The suction head 11, discharge head 13 and an outer cylindrical portion 40 of the monolithic diffuser and return vane channel ring members 30 form the pressure retaining boundary of the pump 1. At each end of the pump 1 is a bearing housing 24. The shaft 20 is provided with a coupling 27 for connecting the pump 1 to a driving device (not shown) such as an electric motor, steam driven turbine or gas turbine.

Figure 2:
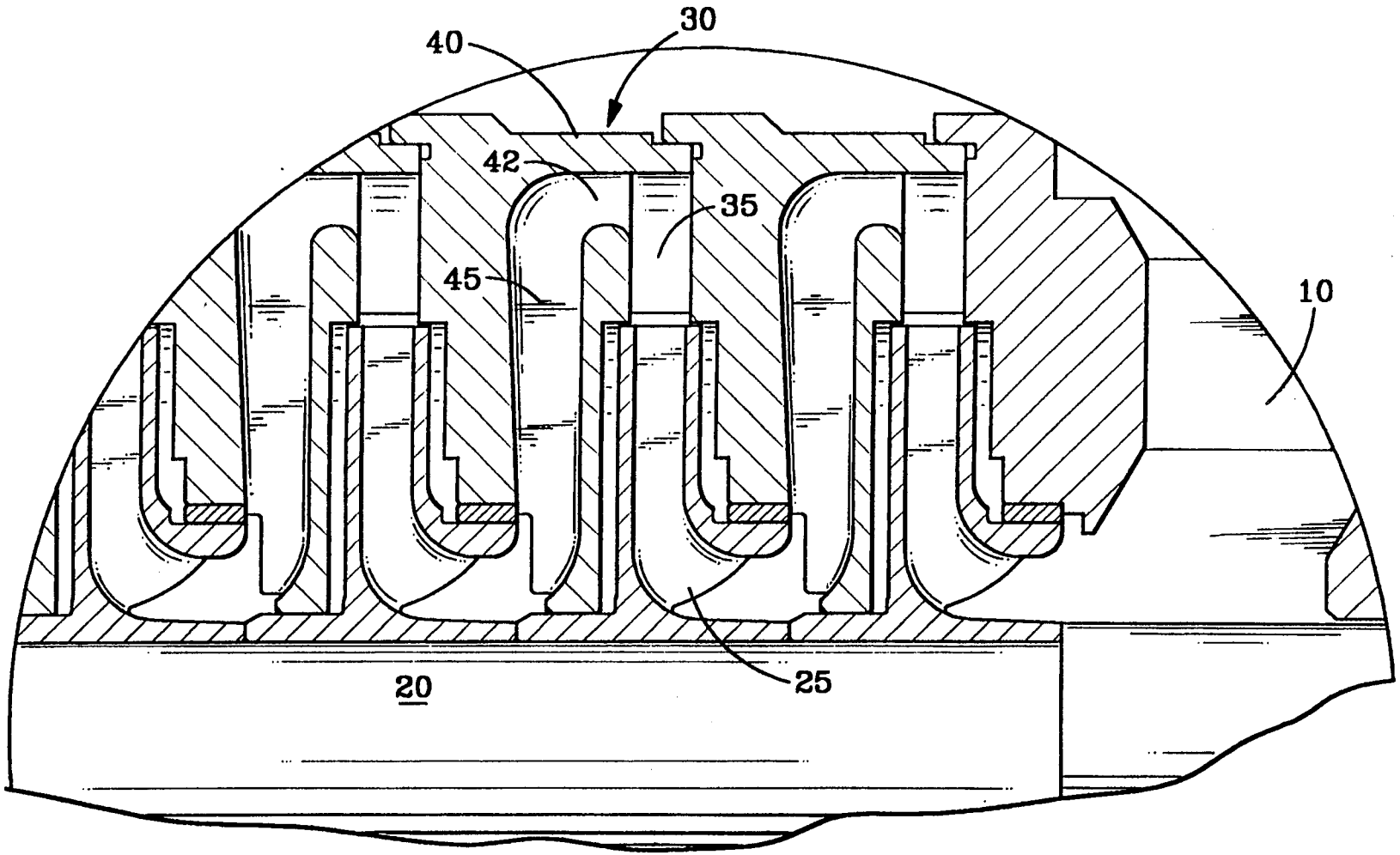
FIG. 2 is a cross-section of a portion of the centrifugal pump shown in FIG. 1.

An enlarged view of several stages of the pump internals is shown in FIG. 2. The pumped fluid enters through the inlet 10 and suction head 11 into an impeller 25 attached to rotating shaft 20. The pumped fluid exits the impeller 25 and enters a diffuser which is part of monolithic diffuser and return vane channel ring member 30 where the increased velocity of the pumped fluid is converted to increased pressure. The higher pressure pumped fluid then enters a return vane section of monolithic diffuser and return vane channel ring member 30 where the pumped fluid is guided to the next stage impeller 25. Additional stages are used as necessary to achieve the required discharge pressure. The stages shown in FIG. 2 are from a eight stage centrifugal pump.

Figure 3:
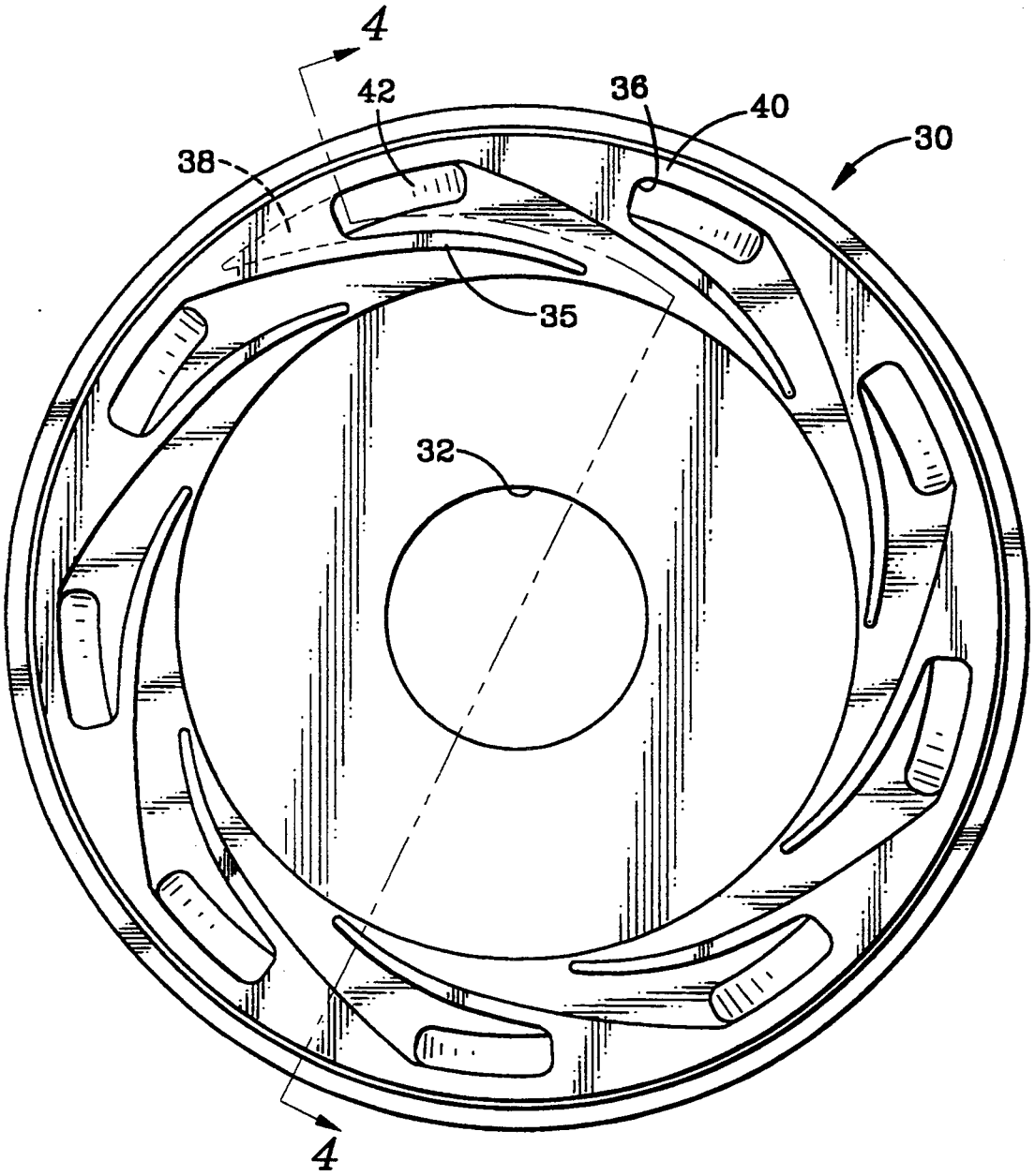
FIG. 3 is a front view of the monolithic diffuser and return vane channel ring member shown in FIG. 2.
Figure 4:
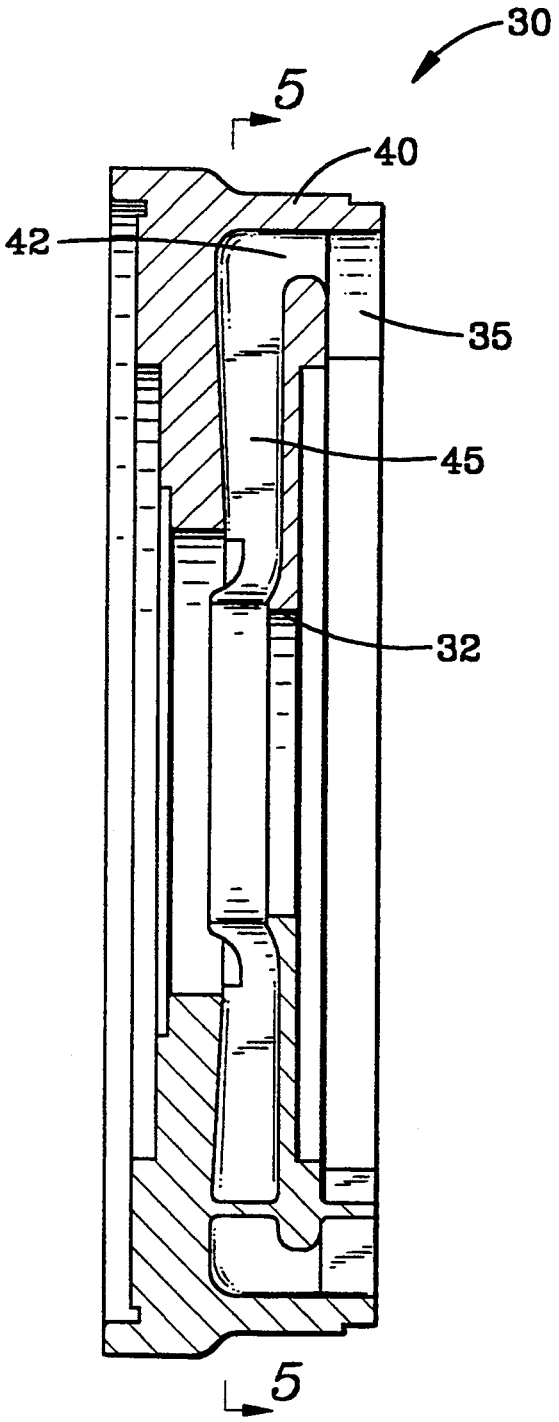
FIG. 4 is a cross-section of the monolithic diffuser and return vane channel ring member taken along line 4—4 of FIG. 3.
Figure 5:
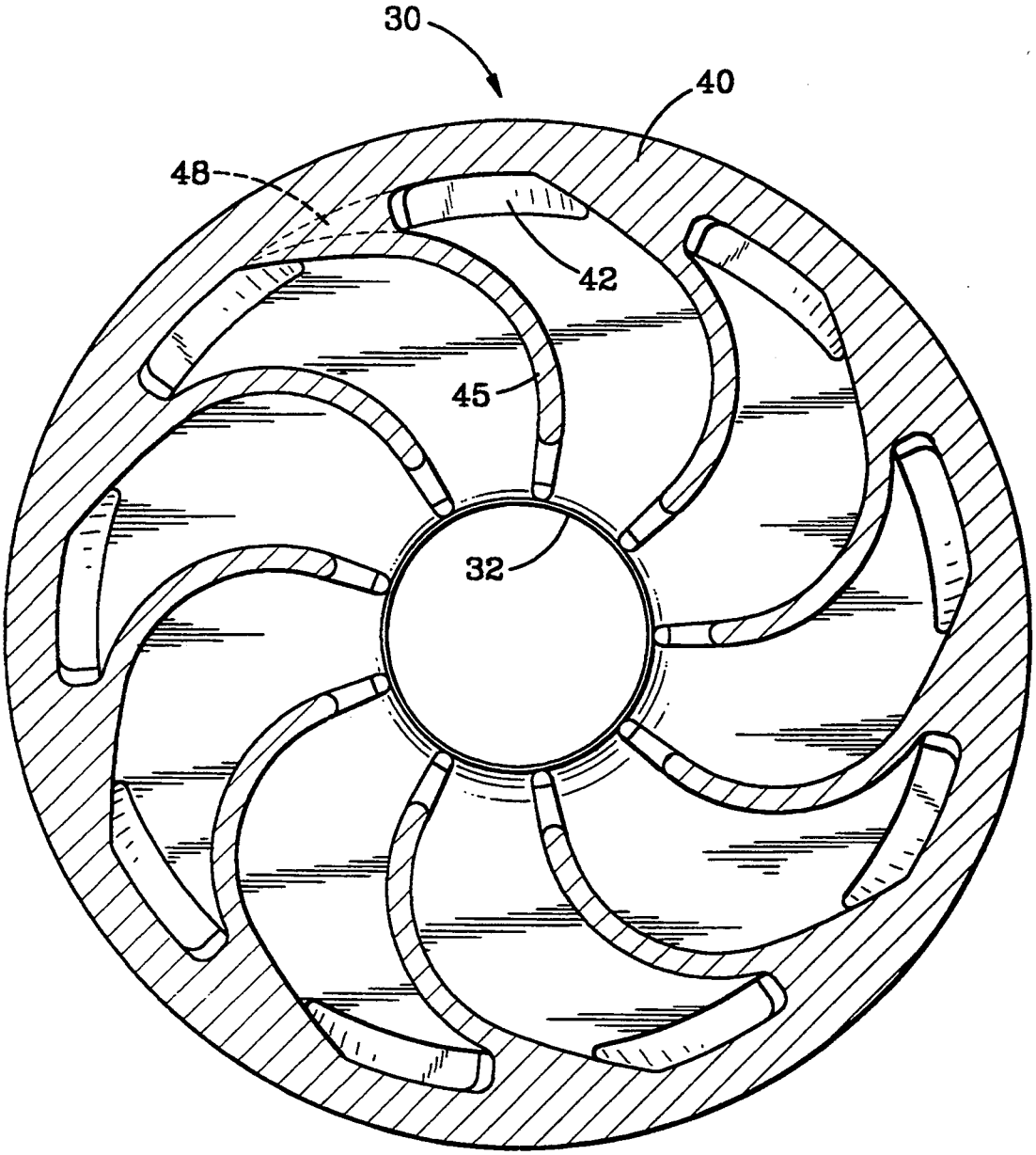
FIG. 5 is a cross-section of the monolithic diffuser and return vane channel ring member taken along line 5—5 of FIG. 4.

FIG. 3 shows the monolithic diffuser and return vane channel ring member 30 from FIG. 2. The channel ring member 30 is an annular disk with an axially extending cylindrical pressure retaining wall 40 about its outer periphery. The inner circumference 32 of the annular disk forms an opening for the pump impeller shaft 20. A plurality of diffuser vanes 35 are located on first side of the channel ring member 30. The diffuser vanes 35, the annular disk and the cylindrical pressure retaining wall 40 form a monolithic structure. A crossover aperture 42 is located at the outer end of each diffuser vane 35. The pumped fluid is guided through these crossover apertures 42 to the return vane section on the second side of the channel ring member 30. A plurality of return vanes 45 (shown in FIG. 5), located on the second side of the channel ring member 30, guide the pumped fluid to the inlet of the next stage impeller 25. In the preferred embodiment, the return vanes 45, the annular disk and the cylindrical pressure retaining wall 40 form a monolithic structure.

The diffuser vanes 35 intersect the cylindrical pressure retaining wall 40 at a tangent. A web 38 of metal is included in the area adjacent the intersection of the diffuser vane 35 and the cylindrical pressure retaining wall 40. The return vanes 45 also intersect the cylindrical pressure retaining wall 40 at a tangent. A second web 48 of metal is included in the area adjacent the intersection of the return vane 45 and the cylindrical pressure retaining wall 40.

In the present invention, the channel ring and the diffuser/crossover hydraulics are formed as a single monolithic casting. By casting the diffuser and the channel ring as a unit, the monolithic diffuser and return vane channel ring member 30 and the diffuser vanes 35 provide structural support to the channel ring or cylindrical pressure retaining wall 40. The channel ring wall thickness has been reduced by taking advantage of the reinforcing function of the monolithic cast piece.

The reinforcement of the pressure retaining wall 40 and the minimum wall thickness can be adjusted by modifying the radius 36 between the diffuser vanes 35 and the pressure retaining wall 40. Increasing the radius between the diffuser vanes 35 (or the return vanes 45) and the pressure retaining wall 40 decreases the circumferential stress in the pressure retaining wall 40, thus allowing further pressure retaining wall 40 thickness reductions.

Radial forces in a traditional channel ring design are distributed continuously along the channel ring circumference. The radial load contributes to the circumferential and nominal stress in the channel ring. Discrete radial loading is evident in the reinforced cylindrical pressure retaining wall 40 of the present invention. Radial forces are generated in areas between diffuser vanes only. Along the diffuser vanes, pressure forces are oriented circumferentially. This reduction of the radial pressure force reduces the circumferential stress in the cylindrical pressure retaining wall 40.

The nominal stress levels for a reinforced and a traditional channel ring design of equal wall thickness vary considerably. The reduction in nominal stress levels in the reinforced channel ring design is due primarily to the reduction of the circumferential stress component. By decreasing the circumferential stress component, the minimum allowable wall thickness is reduced.

Traditional segmental ring centrifugal pumps using separate channel ring members require a channel ring wall thickness of approximately one inch for a 2500 psi pump. One size of centrifugal pump using the monolithic diffuser and return vane channel ring member of the present invention requires a wall thickness of one-half inch for the same design pressure.

Having described the invention, what is claimed is:

1. A multistage centrifugal pump comprising:

a discharge member;

a suction member; a plurality of pumping stages between the suction member and the discharge member, each pumping stage comprising an impeller and a monolithic diffuser and return vane channel ring member, the monolithic diffuser and vane channel ring member comprising an annular disk having an axially extending pressure retaining member at its outer periphery and a plurality of diffuser vanes on one side of the annular disk, the diffuser vanes being integral with the axially extending pressure retaining member; and a plurality of tie bolts extending from the discharge member to the suction member, the tie bolts fastening the monolithic diffuser and return vane channel ring members between the suction member and the discharge member whereby the suction member, the discharge member and the plurality of diffuser and return vane channel ring members form a pressure boundary.

2. The multistage centrifugal pump according to claim 1, further comprising a plurality of web members, a web member being integral with a diffuser vane and the axially extending pressure retaining member.

3. A diffuser comprising:

an annular disk having an axially extending cylindrical pressure retaining member at its outer periphery;

a plurality of diffuser vanes on a first side of the annular disk;

a plurality of return vanes on a second side of the annular disk;

a reinforcing means for reinforcing the pressure retaining member, the reinforcing means comprising the diffuser vanes being integral with the cylindrical pressure retaining member, each diffuser vane intersecting the cylindrical pressure retaining member at a tangent, a plurality of first web members, a first web member being integral with a diffuser vane and the cylindrical pressure retaining member, the return vanes being integral with the cylindrical pressure retaining member, each return vane intersecting the cylindrical pressure retaining member at a tangent, and a plurality of second web members, a second web member being integral with a return vane and the cylindrical pressure retaining member.

4. A multistage centrifugal pump comprising:

a discharge member;

a suction member;

a plurality of pumping stages between the suction member and the discharge member, each pumping stage comprising an impeller and a monolithic diffuser and return vane channel ring member, the monolithic diffuser and return vane channel ring member comprising an annular disk having an axially extending pressure retaining member at its outer periphery, a plurality of diffuser vanes on a first side of the annular disk, a plurality of return vanes on a second side of the annular disk, and a means for reducing circumferrential stress in the axially extending pressure retaining member;

a plurality of tie bolts extending from the discharge member to the suction member, the tie bolts fastening the monolithic diffuser and return vane channel ring members between the suction member and the discharge member whereby the suction member, the discharge member and the plurality of diffuser and return vane channel ring member axially extending presser retaining members form a pressure boundary; and the means for reducing circumferential stress comprising the diffuser vanes and the return vanes being integral with the axially extending pressure retaining member.

5. The multi-stage centrifugal pump according to claim 4, further comprising:

a plurality first web members, a first web member being integral with a diffuser vane and the axially extending pressure retaining member and a plurality of second web members, a second web member being integral with a return vane and the axially extending pressure retaining member.

* * * * *